US006218635B1

(12) United States Patent
Shigemoto et al.

(10) Patent No.: US 6,218,635 B1
(45) Date of Patent: Apr. 17, 2001

(54) PUSH AND ROTARY OPERATING TYPE ELECTRONIC DEVICE

(75) Inventors: Hideki Shigemoto; Hiroshi Matsui; Hiroto Inoue, all of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/502,123

(22) Filed: Feb. 10, 2000

(30) Foreign Application Priority Data

Feb. 10, 1999 (JP) ..... 11-032395

(51) Int. Cl.[7] ..... H01H 19/20

(52) U.S. Cl. ..... 200/570; 200/4; 200/11 R; 200/14

(58) Field of Search ..... 200/45 R, 6 R, 200/6 A, 6 C, 11 R, 11 D, 11 J, 11 K, 11 TW, 329, 16 R–16 D, 330, 336, 341, 18, 564–572

(56) References Cited

U.S. PATENT DOCUMENTS

| | | | | |
|---|---|---|---|---|
| 4,857,677 | | 8/1989 | Tanaka et al. | 200/5 R |
| 5,565,662 | | 10/1996 | Meyrat et al. | 200/4 |
| 5,581,058 | | 12/1996 | Javery et al. | 200/4 |
| 5,593,023 | * | 1/1997 | Kaizaki et al. | 200/570 |
| 5,613,600 | * | 3/1997 | Yokoji et al. | 200/564 |
| 5,711,415 | * | 1/1998 | Fukuda et al. | 200/570 |
| 5,847,335 | * | 12/1998 | Sugahara et al. | 200/4 |
| 5,886,310 | | 3/1999 | Kataoka et al. | 200/14 |
| 5,959,267 | | 9/1999 | Kawasaki et al. | 200/4 |

* cited by examiner

*Primary Examiner*—Michael Friedhofer
(74) *Attorney, Agent, or Firm*—Ratner & Prestia

(57) ABSTRACT

A push and rotary operating type electronic device includes: a cylindrical operating knob supported rotatably about an axis extending through both end surfaces; a rotary contact plate having an electric contact surface, and disposed on one of the end surfaces of the cylindrical operating knob; a rotatable body supported rotatably at one side of it, and for rotatably supporting the cylindrical operating knob; a substrate body for rotatably supporting the cylindrical operating knob and the rotatable body as an integral unit; a push-to-operate type component disposed on the substrate body in a position apart from a supporting portion of the rotatable body in such a manner as to be actuated by a rotational movement of the rotatable body; and a contact bar having a flexible contact blade at one end for contacting resiliently with the electric contact surface provided on the rotary contact plate and an externally connecting terminal at the other end, and fixed to the substrate body. A rotary encoder includes the rotary contact plate and the contact bar. The structure can realize the push and rotary operating type electronic device featuring a smooth operation and high contact reliability, and it can reduce size of equipment wherein this device is housed.

10 Claims, 14 Drawing Sheets

PUSH AND ROTARY OPERATING TYPE ELECTRONIC DEVICE

FIELD OF THE INVENTION

The present invention relates to a push and rotary operating type electronic device mainly employed in communication terminal equipment such as a portable telephone. Such a push and rotary operating type electronic device is operated by rotating a portion of an outer periphery of a cylindrical operating knob projecting from an operating surface of the equipment toward a tangential direction and also by depressing the same toward a center of rotation.

BACKGROUND OF THE INVENTION

A rotary encoder equipped with a push switch such as one shown in a general perspective view of FIG. 12 is a type of push and rotary operating type electronic devices heretofore known.

This rotary encoder equipped with a push switch includes a mount board 1 having contact points, a rotary encoder unit 2 as a rotary operating type electronic component disposed on the mount board 1, and a push switch unit 3 as a push-to-operate type electronic component also disposed on the mount board 1 at an opposite side of the rotary encoder unit 2, as shown in FIG. 12 and a sectioned side view of FIG. 13. The rotary encoder unit 2 is fixed in such a manner as to be movable for a certain extent in a vertical direction (the direction of an arrow V shown in FIG. 12 and FIG. 13). The push switch unit 3 is fixed so as not to be movable.

The mount board 1 having contact points includes a plate-shaped plastic body provided with a recess 5 including guide rails 4 for the rotary encoder unit 2 to move along, another recess 6 for fixing the push switch unit 3, and contact plates 8 having terminals 7 protruding downwardly for leading an electric signal of the rotary encoder unit 2 to an outside, as shown in a general perspective view of FIG. 14.

The rotary encoder unit 2 includes: (a) a sliding contact body 9 made of plastic, inserted into the recess 5 of the mount board 1 having contact and retained by the guide rails 4 so as to be movable within a certain extent in the vertical direction (the direction of the arrow V shown in FIG. 12 and FIG. 13); (b) a resilient metal plate 10 mounted in plastic resin of the sliding contact body 9 by insertion molding, and having flexible contact blades 11A and 11B extending both forward and backward; (c) a rotor 14 made of plastic provided on its back surface with a radially-extended movable contact plate 13, to which the flexible contact blade 11A makes resilient contact, and held rotatably with a cylindrical axle 12, which is fixed in a center of the sliding contact body 9; and (d) a disk-shaped operating knob 15 mounted with the cylindrical axle 12 in between so as to rotate the rotor 14, as shown in the sectioned side view of FIG. 13. The flexible contact blade 11B extending backward from the sliding contact body 9 is in resilient contact with the contact plates 8 on the mount board 1 having contact points in order to lead an electric signal from the rotary encoder unit 2.

A leaf spring 16 protruding from a bottom end of the sliding contact body 9 provides for a biasing force by contacting resiliently against pin-shaped projections 17 (refer to FIG. 14) on a front surface of the mount board 1 having contact points in order to maintain the rotary encoder unit 2 in a position apart from the push switch unit 3 in an ordinary condition.

The push switch unit 3 is fixed on the mount board 1 having contact points by being inserted in the recess 6 on a surface opposite to the rotary encoder unit 2 in a manner that an actuating button 18 of the push switch unit 3 is in contact with a pushing section 12A at the backside of the cylindrical axle 12 of the rotary encoder unit 2, as shown in FIG. 13. Terminals 19 for leading an electric signal to the outside protrude downwardly below the mount board 1.

As the rotary encoder equipped with a push switch is constructed as above, it is mounted on a wiring board 20 in equipment, with the terminals 7 of the rotary encoder unit 2 and the terminals 19 of the push switch unit 3, all protruding from a mount surface at the underside of the mount board 1, inserted into mount holes 21 and 22 and soldered, as shown in FIG. 15, when it is installed in the communication terminal equipment and the like.

The rotary encoder is installed in a manner that a peripheral rim 15A of the disk-shaped operating knob 15 protrudes from an operating surface 23 on an upper enclosure of the equipment in order that the peripheral rim 15A is manipulable.

The rotary encoder equipped with a push switch constructed as above operates in a manner, which will be described hereinafter.

When the peripheral rim 15A of the disk-shaped operating knob 15 is turned by applying a force in a tangential direction (the direction of an arrow H shown in FIG. 12), the rotor 14 rotates about the cylindrical axle 12.

A flexible contact blade 11A fixed to the sliding contact body 9 at a front side slides resiliently over the radially-extended movable contact plate 13 on the back surface of the rotor 14 so as to make and break an electric current, thereby functioning as the rotary encoder unit 2. The electric current is transferred from the flexible contact blade 11A to the contact plate 8 on the mount board 1 having contact points via the flexible contact blade 11B in the back. The electric current is then communicated to a circuit on the wiring board 20 of the equipment through the terminals 7 provided for external connection.

As shown in FIGS. 13 and 15, a depressing force is given on the peripheral rim 15A of the disk-shaped operating knob 15 in a vertically downward direction (the direction of the arrow V1) toward a center of the disk-shaped operating knob 15 against a biasing force of the leaf spring 16, which thrusts the rotary encoder unit 2 upward, to move the whole rotary encoder unit 2 along the guide rails 4 on the mount board 1 having contact points. This causes the pushing section 12A of the cylindrical axle 12 to press the actuating button 18, and actuates the push switch unit 3. Contacts of the push switch unit 3 close a circuit of the wiring board 20 of the equipment via the terminals 19.

The rotary encoder unit 2 is thrust back and returns into its original position by the resilient restoring force of the leaf spring 16, when the depressing force being given to the disk-shaped operating knob 15 is removed.

When mounting the push and rotary operating type electronic device of the prior art on communication terminal equipment or the like, however, it shall be so mounted as to avoid the mount board 1 having contact points from coming out of the operating surface 23 of the upper enclosure. Since the mount surface of the mount board 1 to be mounted on the wiring board 20 is designed to locate in a position considering the lowest portion of the outside diameter and upward/downward within its movable range of the peripheral rim 15A of the disk-shaped operating knob 15, a space between the operating surface 23 and the wiring board 20 in the equipment needs to be widened. This causes a problem that a thickness of the equipment from the operating surface 23 of the upper enclosure to a rear surface of a bottom enclosure becomes so bulky.

In addition, the push and rotary operating type electronic device of the prior art requires a circuit for the signal of the rotary encoder unit 2 to include a path through the flexible contact blade 11B on the sliding contact body 9 and the contact plates 8 on the mount board 1, thereby giving rise to another problem that demands great care in handling during assembling and for maintaining reliable electrical contacts in a long term of usage due to many flexible contacts and sliding contact plates.

SUMMARY OF THE INVENTION

A push and rotary operating type electronic device includes: (a) an operating knob having an extended width and a cylindrical shape, and an outer peripheral surface of which is protruded from an operating surface on an upper enclosure of equipment; (b) a substrate body for rotatably supporting a rotatable body at its one side, the rotatable body supporting the cylindrical operating knob rotatably; (c) a rotary operating type component having a rotary contact plate on one of end surfaces of the cylindrical operating knob and a flexible contact blade fixed to the substrate body; and (d) a push-to-operate type component disposed on the substrate body in a manner that it is operated by a rotational movement of the rotatable body caused by a depressing manipulation of the cylindrical operating knob.

The push and rotary operating type electronic device of the invention, to be more specific, includes: the cylindrical operating knob supported at both of its end surfaces in a manner to be rotatable around its axis, and for being manipulated with the peripheral surface; the rotary contact plate having an electric contact surface, and disposed on one of the end surfaces of the cylindrical operating knob; the rotatable body supported rotatably at one side of it, and for rotatably supporting the cylindrical operating knob; the substrate body for rotatably supporting the rotatable body together with the cylindrical operating knob as an integral unit; the push-to-operate type component disposed on the substrate body in a position apart from a supporting portion of the rotatable body in such a manner as to be operated by rotational motion of the rotatable body; and a contact bar having the flexible contact blade at one end for contacting resiliently with an electric contact surface provided on the rotary contact plate and an externally connecting terminal at the other end of it, and fixed to the substrate body.

A push and rotary operating type electronic device has such features as: (a) it can enlarge the manipulating surface of the operating knob because of its extended width and cylindrical shape; (b) it can reduce a height dimension of an enclosure of the equipment in which this push and rotary operating type electronic device is installed; (c) the push-to-operate type component can be manipulated smoothly, since the rotatable body can move around the supporting part at one side of it, when the cylindrical operating knob is depressed; and furthermore (d) it provides high contact reliability at a low cost, since it contains a small number of resilient contacts and contacting points.

The push and rotary operating type electronic device is provided with an actuator having resiliency as an integral part of or securely fixed to the rotatable body. The push-to-operate type component is actuated by depressing it with this actuator. The actuator having resiliency has an effect of buffering an adverse effect to the push-to-operate type component, if an impulsive load is applied in a direction of depressing the cylindrical operating knob. The actuator can also prevent the push-to-operate type component from making an abnormal sound due to an angular play in the rotatable body.

The push and rotary operating type electronic device includes a spring disposed between the rotatable body and the substrate body for providing a biasing force in a direction of separating them with respect to each other. Disposing the spring allows adjustment of the depressing force required to manipulate the push and rotary operating type electronic device to an appropriate value. The spring can also reduce the likelihood of actuating the push-to-operate type component erroneously during a rotating manipulation of the cylindrical operating knob. It also has an effect of preventing an abnormal sound due to an angular play in the rotatable body.

The push and rotary operating type electronic device is so constructed that the rotatable body is supported rotatably from both ends at one side of it in a direction parallel to a rotational axis of the cylindrical operating knob, in a span wider than a longitudinal dimension of the cylindrical operating knob, and the push-to-operate type component is disposed at the other side in generally mid point between the supporting portions at both ends of the rotatable body. This structure has an advantageous effect for making the push-to-operate type component to operate by rotating the rotatable body smoothly irrespective of position on a peripheral surface of the cylindrical operating knob where upon the depressing force is applied, when manipulating the cylindrical operating knob.

The push and rotary operating type electronic device includes a rotary encoder and a push switch to serve respective functions of the rotary operating type component and the push-to-operate type component. The electronic component providing function of a rotary encoder equipped with a push switch can be connected directly to a digital circuit such as a microcomputer and the like, that are used widely for communication equipment in late years, thereby providing an advantage of simplifying control of the equipment.

The push and rotary operating type electronic device is provided with a plurality of radially-oriented ditches and ridges on either of an end surface of the cylindrical operating knob and the rotary contact plate. A bulge on a resilient body retained by the rotatable body is in contact resiliently and slidably on the radially-oriented ditches and ridges. In this structure, the rotary contact plate stops in such a position where the flexible contact blade does not stay in contact with the electric contact surface, when the bulge on the rotatable body slips into any one of ditches. This structure has such advantages as providing a stable manipulation accompanying a feel of clicks when turning the cylindrical operating knob, and no likelihood of producing an erroneous signal due to a malfunction of the rotary operating type component during a manipulation of the push-to-open component.

The push and rotary operating type electronic device disposes the flexible contact blade fixed to the substrate body in a manner to make resilient contact with the rotary contact plate in a position on or close to a line drawn between a center of the rotary contact plate and a rotational axis, i.e. a center of a rotational motion of the rotatable body. This arrangement gives an advantage of reducing a shift in position where the flexible contact blade makes resilient contact with the rotary contact plate during a depressing manipulation of the cylindrical operating knob. It also helps to assure a length of the flexible contact blade necessary for it to keep a predetermined magnitude of flexion.

The push and rotary operating type electronic device disposes the flexible contact blade fixed to the substrate body in a manner to make resilient contact with the rotary contact plate in a position on or extremely close to a line, which passes through a center of the rotary contact plate in a direction perpendicular to the line drawn between the center of the rotary contact plate and the rotational axis, i.e. the center of the rotating motion of the rotatable body. This arrangement gives an advantage of virtually eliminating adverse effect of a shift in position where the flexible contact blade makes resilient contact with the rotary contact plate during a depressing manipulation of the cylindrical operating knob, by allowing a fair margin of a dimension in a radial direction of the rotary contact plate, since the shift occurs in this direction only.

The push and rotary operating type electronic device has a distinctive structure in that: (a) the cylindrical operating knob is provided with a recess of large diameter at one of end surfaces and a circular hole in a center of the other one of the end surfaces; (b) the rotary contact plate is fixed in an inner periphery of the recess; (c) the cylindrical operating knob is rotatably supported by inserting from an exterior side a supporting axle of a relatively thin diameter fixed to the rotatable body through a small circular hole in a center of the rotary contact plate, and inserting another supporting axle projecting from the rotatable body into the circular hole in the other end surface; (d) the flexible contact blade fixed to the substrate body is held to be in resilient contact with the electric contact surface on an exterior side of the rotary contact plate; and (e) the bulge on the resilient body fixed to the thin supporting axle is held to be in contact resiliently with the ditches and ridges on an interior side surface of the rotary contact plate within the recess. This structure provides an advantage of realizing the push and rotary operating type electronic device of small size that produces a feel of clicks during a rotating manipulation of the cylindrical operating knob, and gives a smoothness in depressing manipulation.

Furthermore, the push and rotary operating type electronic device has a structure in that (a) the rotatable body, the thin supporting axle and the resilient body are made of metallic material, and (b) a flexible contact having an electrical continuity to a grounding terminal and fixed to the substrate body is so positioned as to be in contact resiliently with the rotatable body. This structure provides an effect of reliably protecting the equipment from an adverse effect of static electricity generated during manipulation of a peripheral surface of the cylindrical operating knob.

DESCRIPTION OF THE PREFERRED EMBODIMENTS

First Exemplary Embodiment

Figure 1:
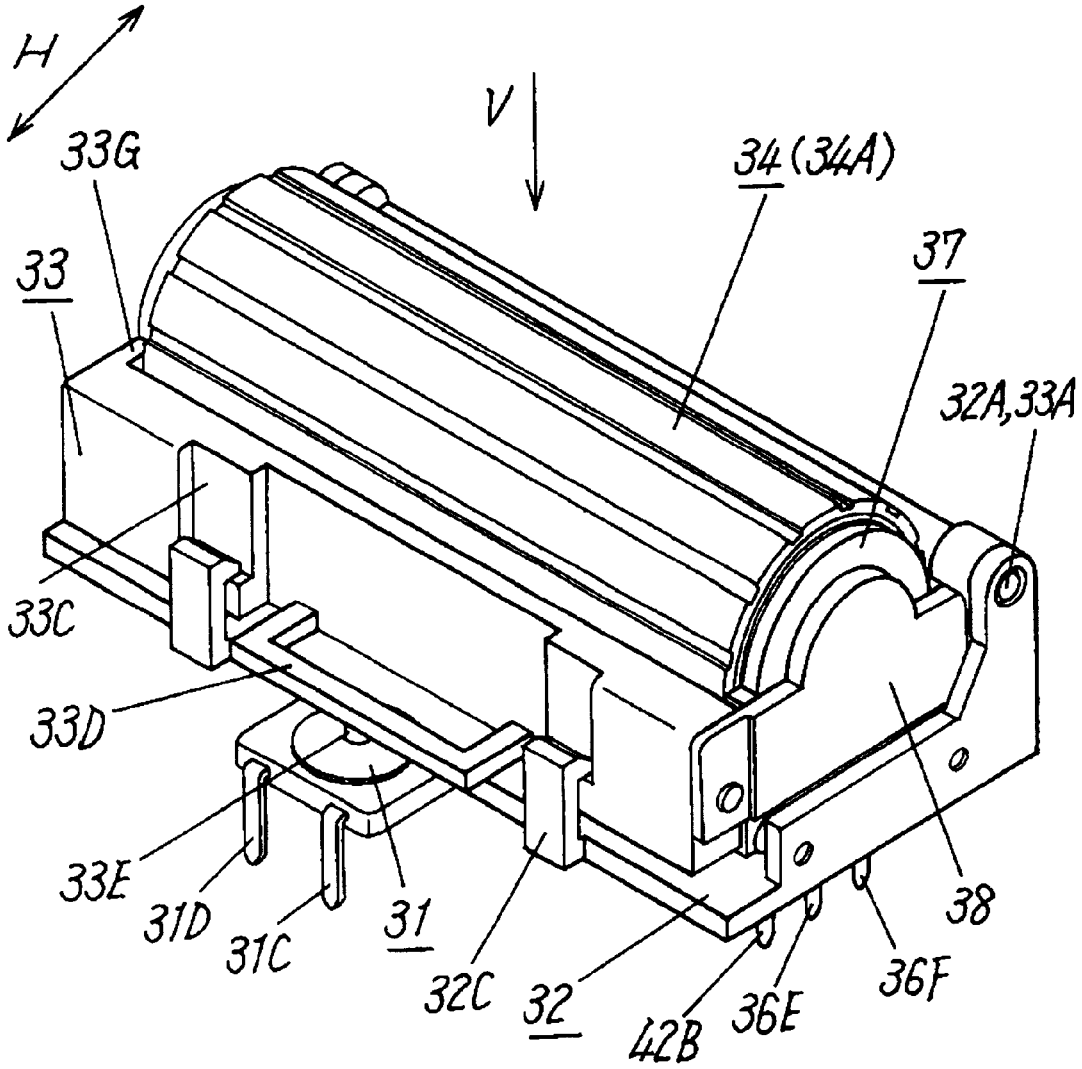
FIG. 1 is a general perspective view depicting a rotary encoder equipped with a push switch, representing a push and rotary operating type electronic device of a first exemplary embodiment of the present invention.
Figure 2:
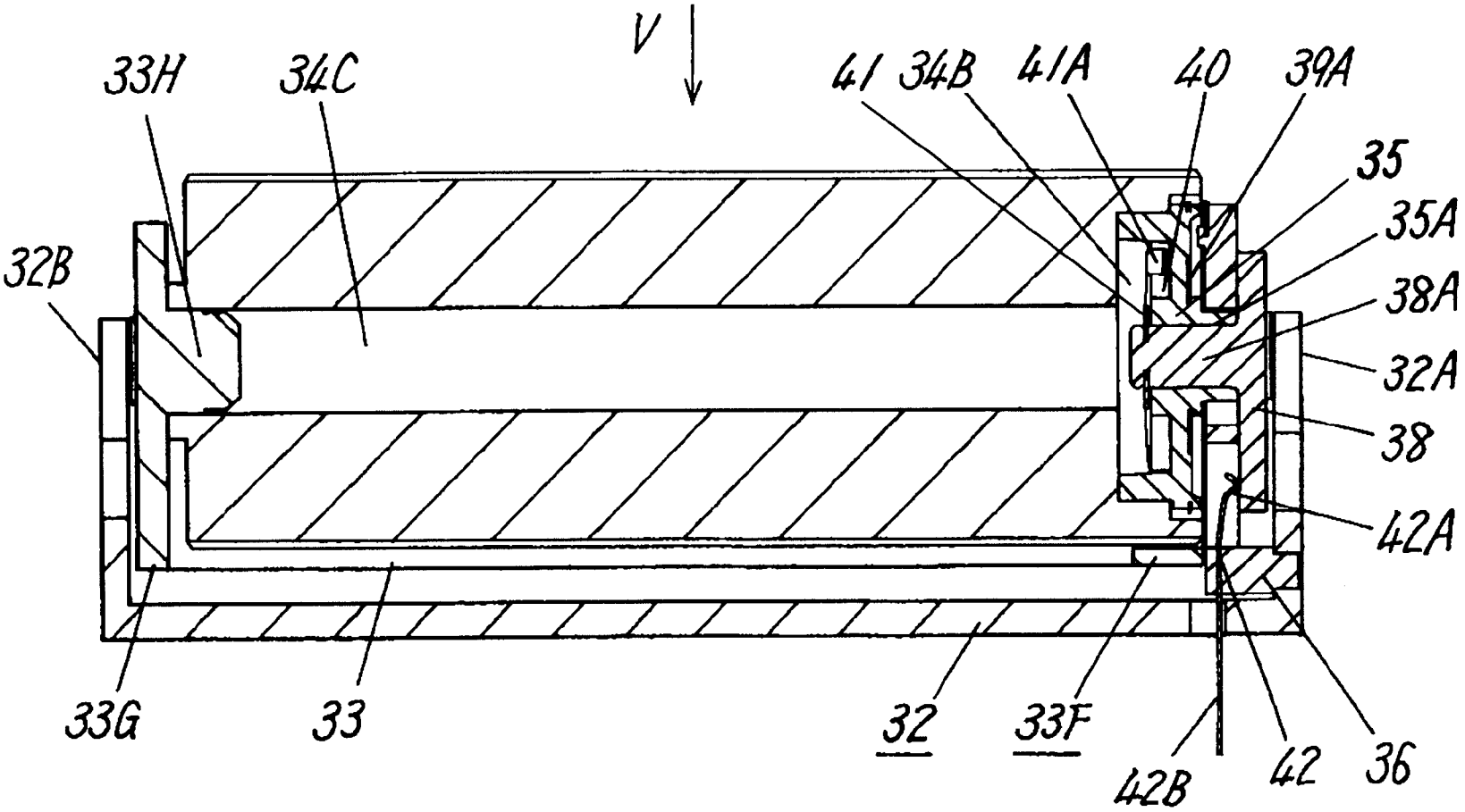
FIG. 2 is a longitudinal sectional view depicting the same rotary encoder equipped with a push switch, as is taken along a vertical plane across a center of a rotary axis.

FIG. 1 is a general perspective view depicting a rotary encoder equipped with a push switch, representing a push and rotary operating type electronic device of a first exemplary embodiment of the present invention; FIG. 2 is a longitudinal sectional view taken along a vertical plane across a center of a rotary axis; and FIG. 3 is an exploded perspective view depicting the same.

Figure 3:
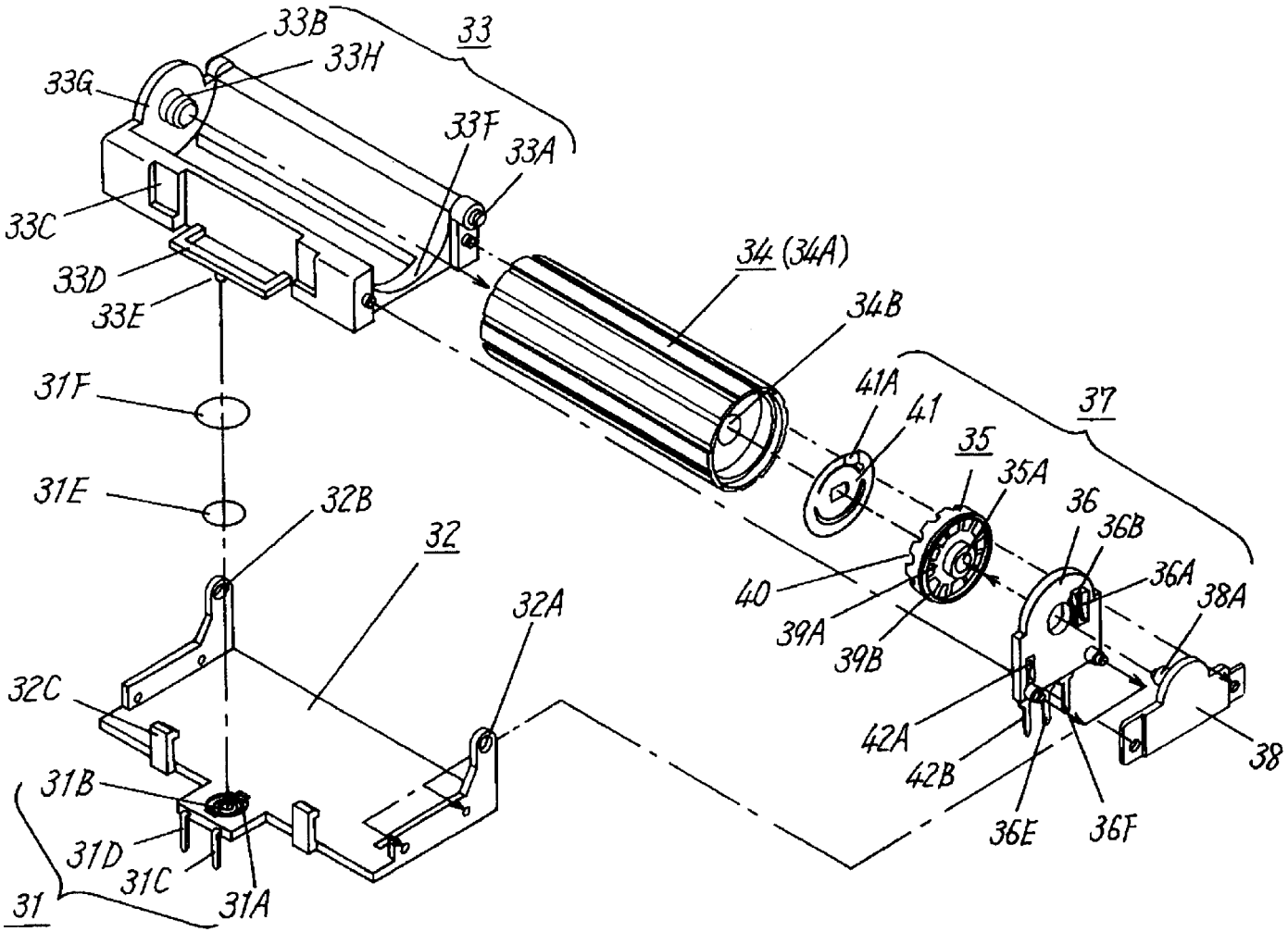
FIG. 3 is an exploded perspective view depicting the same rotary encoder equipped with a push switch.

As shown in FIG. 1 through FIG. 3, the rotary encoder equipped with a push switch of this exemplary embodiment includes: (a) a substrate body 32 provided with a push switch unit 31 serving as a push-to-operate type component on its upper surface; (b) a rotatable body 33 supported rotatably by the substrate body 32; (c) a cylindrical operating knob 34 as an actuator held rotatably on the rotatable body 33, and (d) a rotary encoder unit 37 serving as a rotary operating type component including flexible contact blades 36A and 36B fixed to the substrate body 32 in a manner to make resilient contact against a rotary contact plate 35 held on an end surface of the cylindrical operating knob 34.

The substrate body 32 made of plastic has a shape of flat plate. A pair of stationary contacts 31A and 31B is fixed in a circular recess located at one side in generally mid point of it by insertion molding in a manner that they are exposed on an upper surface. Connecting terminals 31C and 31D, each having an electrical continuity with their respective stationary contacts 31A and 31B, are led out downwardly at one side of the substrate body 32.

The push switch unit 31 is formed by placing a circular dish-like resilient movable contact 31E over the stationary contacts 31A, and covering the top of them by a flexible film 31F.

A pair of circular supporting holes 32A and 32B are provided facing against each other at both ends of the substrate body 32 at a longitudinal side opposite to the push switch unit 31.

The rotatable body 33 is a square-shaped frame made of metal, and projections 33A and 33B on both ends at one side of it are supported rotatably by the pair of circular supporting holes 32A and 32B of the substrate body 32. A hook 32C extended from the substrate body 32 to connect with a longitudinal side frame 33C opposite to the supported side limits a position of the rotatable body 33 below an upper bound.

A projection 33E located on a lower surface of a flexible arm 33D provided near the longitudinal side frame 33C stays in contact with a top end of the push switch unit 31, so as to maintain the rotatable body 33 in the upper bound position within its movable limit under normal conditions.

The rotatable body 33 actuates the push switch unit 31 when it rotates and moves downward from this ordinary position.

The cylindrical operating knob 34 having a peripheral manipulation surface 34A in a longitudinal width smaller than a span between the pair of circular supporting holes 32A and 32B is retained inside of the frame of the rotatable body 33. The cylindrical operating knob 34 is rotatable about a rotary axis shown as a dashed line in FIG. 3, which is in parallel to a rotational axis of the rotatable body 33 between the two projections 33A and 33B.

The cylindrical operating knob 34 has the rotary contact plate 35, which is press-fixed to an inner periphery of a recess 34B provided in one end surface of it, as shown in FIG. 2. The cylindrical operating knob 34 is rotatably supported by a thin supporting axle 38A and another supporting axle 33H projecting coaxially in a manner to face the thin supporting axle 38A. That is, the cylindrical operating knob 34 is rotatably supported by the thin supporting axle 38A projecting from a metal cover plate 38 overlaid on and fixed to a cross side frame 33F of the rotatable body 33, and the supporting axle 33H projecting from another cross side frame 33G in parallel with the cross side frame 33F in a manner to face the thin supporting axle 38A along a coaxial line, that these two supporting axles 38A and 33H inserted respectively into a small circular hole 35A in a center of the rotary contact plate 35 and a circular hole 34C in a center of the other end surface of the operating knob 34.

Figure 4:
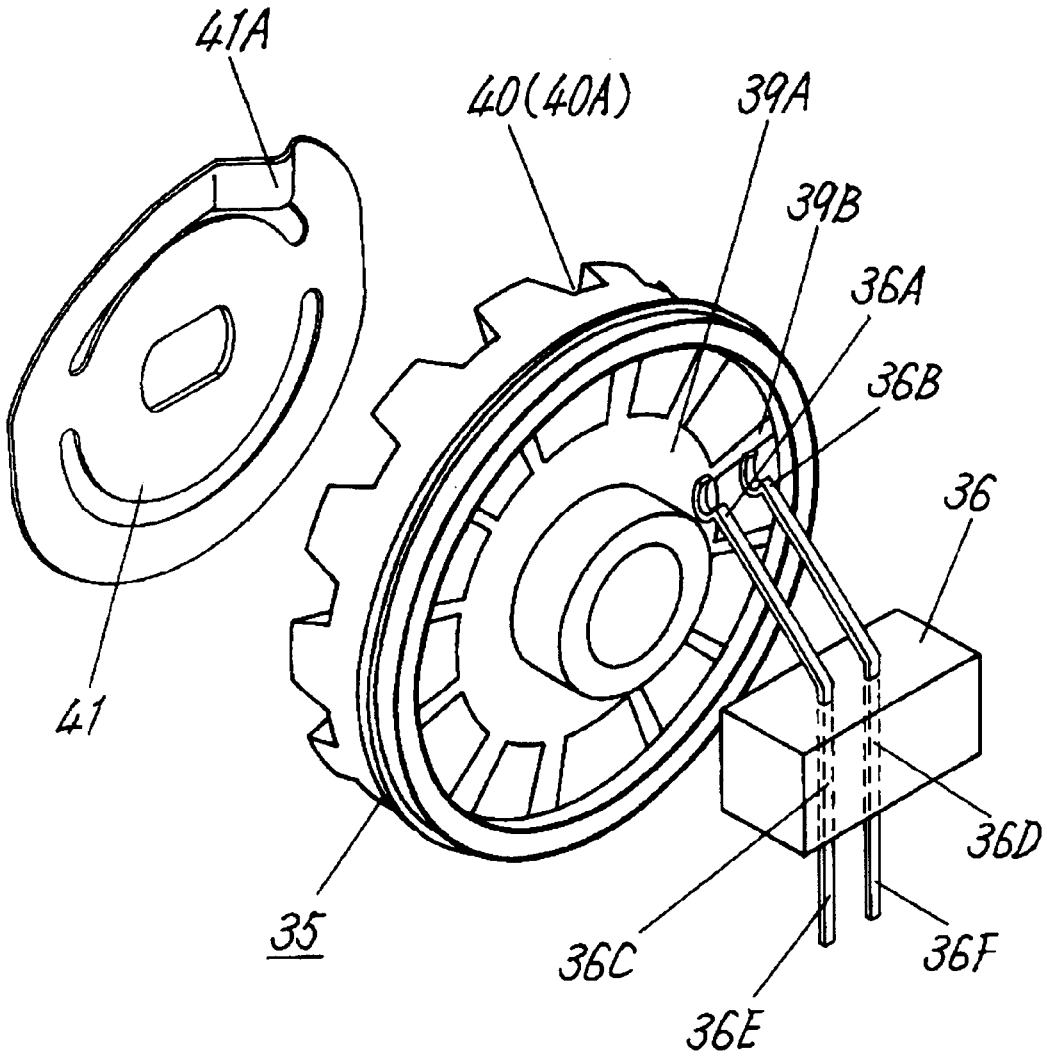
FIG. 4 is a schematic view depicting a portion in vicinity of encoder contacts of the same rotary encoder equipped with a push switch.

The rotary contact plate 35 is provided on its exterior side surface with a center contact portion 39A serving as a common contact point and a plurality of radial contact points 39B extending radially outward from the center contact point 39A at predetermined angular intervals, as shown in FIG. 4. The two flexible contact blades 36A and 36B of contact bars 36C and 36D held by insertion molding in a contact board 36, which is fixed on the substrate body 32, maintain resilient contacts with this electric contact surface, and connecting terminals 36E and 36F respectively in continuity with the contact bars 36C and 36D are led downward. The rotary contact plate 35 is provided on its interior side surface with a plurality of radially-oriented ridges and ditches 40 in corresponding angular arrangement with the radial contact portions 39B. A resilient bulge 41A on a leaf spring 41 made of resilient metal plate and fixed to a tip end of the thin supporting axle 38A is made to contact resiliently with plurality of the radially-oriented ridges and ditches 40 within the recess 34B in the cylindrical operating knob 34.

When the rotary contact plate 35 is turned with the cylindrical operating knob 34, the flexible contact blades 36A and 36B slide resiliently on the center contact portion 39A and the radial contact portions 39B, and the resilient bulge 41A slides resiliently on the radially-oriented ridges and ditches 40 respectively, so as to function as the rotary encoder unit 37 for generating an electric signal (pulse signal) between the connecting terminals 36E and 36F, while producing a feeling of clicks.

Figure 5:
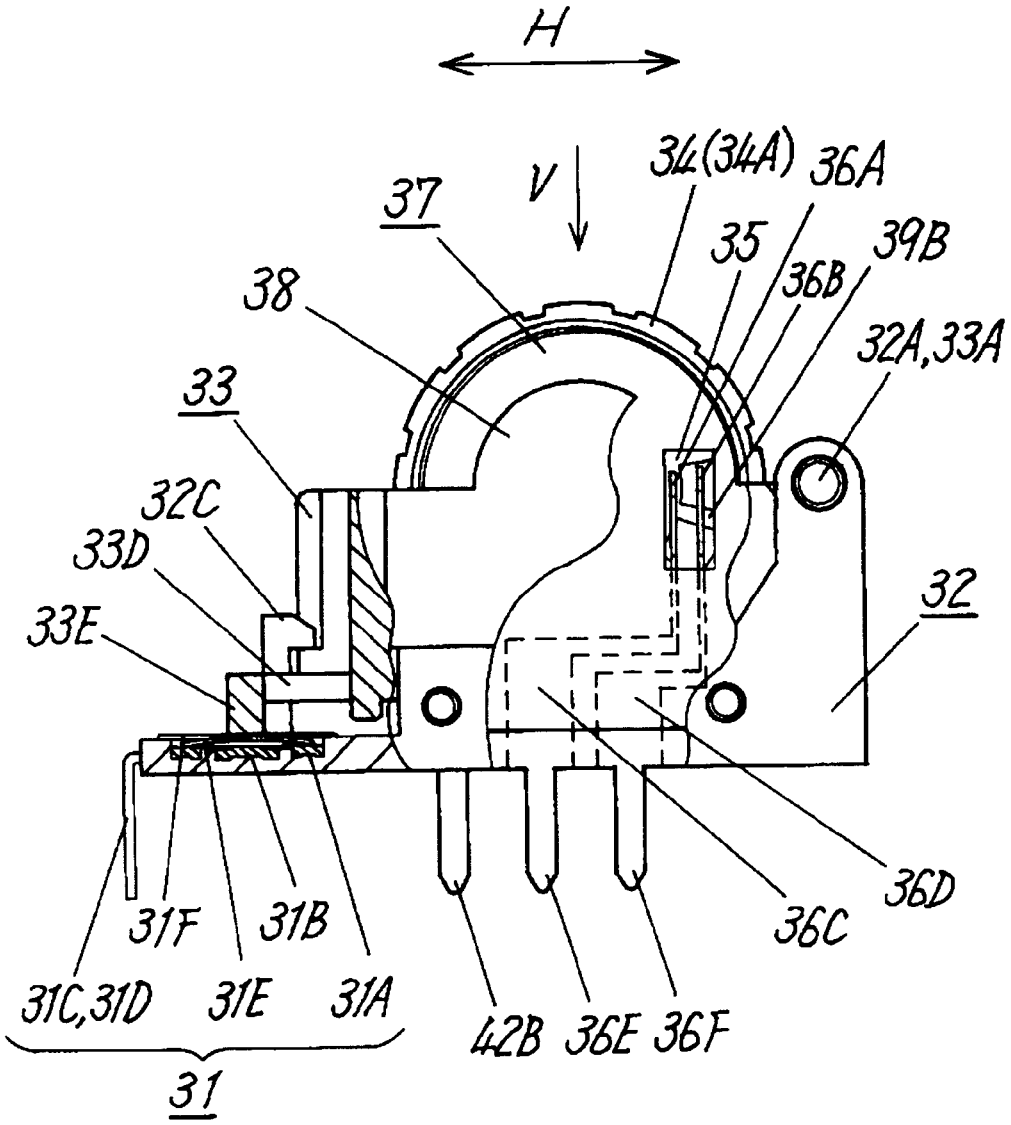
FIG. 5 is a partially sectioned side view depicting the same rotary encoder equipped with a push switch.

Positions where the flexible contact blades 36A and 36B make resilient contact with the exterior side surface of the rotary contact plate 35 are located on or near a line connecting in phantom from a center of the rotary contact plate 35 to a center of the circular supporting holes 32A and 32B, i.e. an rotational axis of a rotational motion of the rotatable body 33, and in between these centers, as shown in FIG. 5. The flexible contact blade 36B is so placed that it does not contact with any of the radial contact portions 39B, but remains in position on an insulated surface area, when the rotary contact plate 35 stays in any rotated position in which the resilient bulge 41A of the leaf spring 41 in contact with the interior side surface is caught in one of the ditches 40A among the radially-oriented ridges and ditches 40.

In addition, a grounding contact bar 42 (refer to FIG. 2) is fixed in the contact board 36 by insertion molding in line with the contact bars 36C and 36D. A flexible contact blade 42A of the grounding contact bar 42 makes a resilient contact on the metal cover plate 38, and a connecting terminal 42B extending downward is connected to a grounding circuit in the equipment.

The rotary encoder equipped with a push switch of the present exemplary embodiment is constructed as above, and it operates in a manner, which will be described next.

In FIG. 1 through FIG. 5, when the cylindrical operating knob 34 is turned by applying a force in a tangential direction (the direction of an arrow H shown in FIG. 1 and FIG. 5) on an upper part of the peripheral manipulation surface 34A, the rotary contact plate 35 mounted to the cylindrical operating knob 34 rotates about the thin supporting axle 38A.

According to the rotation of the rotary contact plate 35 a flexible contact blades 36A and 36B fixed to the substrate body 32 slide resiliently over the center contact portion 39A and radial contact portions 39B on the exterior side surface of the rotary contact plate 35, to make and break a circuit, and function as the rotary encoder unit 37.

At the same time, the resilient bulge 41A of the leaf spring 41 slides resiliently on the plurality of radially-oriented ridges and ditches 40 on the interior side surface of the rotary contact plate 35 to produce a feeling of clicks in coordination with the making and breaking of the circuit.

When the cylindrical operating knob 34 stops rotating, the resilient bulge 41A slips into one of the ditches 40A among the radially-oriented ridges and ditches 40, and the flexible contact blade 36B stops on the insulated surface area separated from the radial contact portions 39B.

Signal from the rotary encoder unit 37 is transferred via the connecting terminals 36E and 36F to the circuit in the equipment in which the rotary encoder is used.

Incidentally, a depressing force is applied downwardly on the upper part of the cylindrical operating knob 34, when it is turned. However, a force required to cause the dish-like resilient movable contact 31E of the push switch unit 31, with which the flexible arm 33D of the rotatable body 33 supporting the cylindrical operating knob 34 makes contact, to make an elastic deformation may be designed to be greater than the depressing force so that an erroneous operation of the push switch unit 31 can be avoided during the rotating manipulation of the rotary encoder unit 37.

Furthermore, a location on the peripheral manipulation surface 34A of the cylindrical operating knob 34, to which the tangential force is applied, is not necessarily the upper part at the center in a widthwise direction of the peripheral manipulation surface 34A of the cylindrical operating knob 34. The cylindrical operating knob 34 can rotate smoothly in the like manner, even if the force is applied to the cylindrical operating knob 34 at any other locations off the center toward either the right side or the left side, and the rotary encoder unit 37 can be operated satisfactorily. Static electricity may be generated by a hand and fingers of an operator making contact with the peripheral manipulation surface 34A of the cylindrical operating knob 34. However, the static electricity does not cause an adverse effect to the circuit of the equipment, since it is discharged from the metal rotatable body 33 and the cover plate 38 to a grounding circuit of the equipment via the flexible contact blade 42A and the connecting terminal 42B of the grounding contact bar 42.

Figure 6:
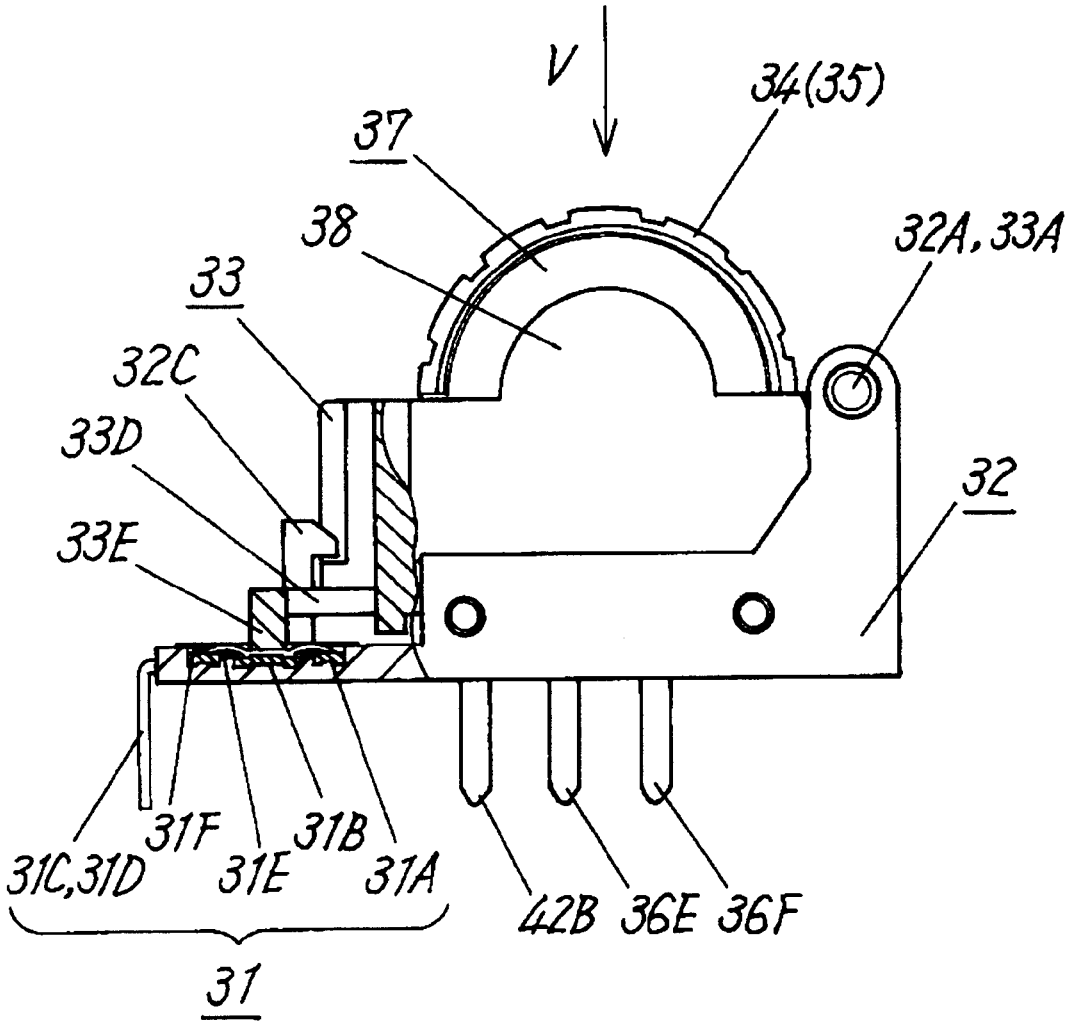
FIG. 6 is another partially sectioned side view depicting the same rotary encoder equipped with a push switch wherein a push switch unit is in its actuated position.

On the other hand, when a depressing force is applied vertically downward (the direction of the arrow V) to the upper part of the peripheral manipulation surface 34A of the cylindrical operating knob 34 in order to push down the cylindrical operating knob 34, as shown in FIG. 6, the rotatable body 33 supporting the cylindrical operating knob 34 makes a rotational movement around the rotational axis across the projections 33A and 33B. This motion of the rotatable body 33 causes the projection 33E on the underside surface of the flexible arm 33D to push a center portion of the dish-like resilient movable contact 31E above the stationary contact 31A downward via the flexible film 31F of the push switch unit 31 on the substrate body 32, and thereby forcing the resilient movable contact 31E to make an elastic deformation.

An underside surface at the center of the resilient movable contact 31E comes into contact with the stationary contact 31B, so as to close between the stationary contacts 31A and 31B. This makes an electrical continuity of the push switch unit 31, and an electric current is transferred to a circuit in the equipment via the connecting terminals 31C and 31D.

When the depressing force applied to the cylindrical operating knob 34 is removed thereafter, an elastic restoring force of the resilient movable contact 31E of the push switch unit 31 pushes back the rotatable body 33 into its original position shown in FIG. 5 via the flexible arm 33D, and thereby the push switch unit 31 turns into an open mode.

The push switch unit 31 functions as a push-on type switch in the case described above.

In this exemplary embodiment, a location on the peripheral manipulation surface 34A of the cylindrical operating knob 34, to which the depressing force is applied when actuating the push switch unit 31, is not necessarily the upper part at the center in the widthwise direction of the peripheral manipulation surface 34A of the cylindrical operating knob 34. The rotatable body 33 can be moved smoothly to actuate the push switch unit 31, even if the depressing force is applied to the cylindrical operating knob 34 at any other locations off the center toward either the right side or the left side, since the peripheral manipulation surface 34A of the cylindrical operating knob 34 has the longitudinal width smaller than the span between the pair of circular supporting holes 32A and 32B of the substrate body 32 retaining the rotatable body 33, as has been described.

In addition, the rotary contact plate 35 of the rotary encoder unit 37 does not rotate while actuating the push switch unit 31 with a depressing force applied to the cylindrical operating knob 34, because the resilient bulge 41A of the leaf spring 41 stays in one of the ditches 40A among the radially-oriented ridges and ditches 40 on the interior side surface of it, as described above.

The points where the flexible contact blades 36A and 36B, i.e. contact points of the rotary encoder unit 37, contact resiliently on the center contact portion 39A and the radial contact portions 39B on the exterior side surface of the rotary contact plate 35 shift slightly, when actuating the push switch unit 31. However, this does not cause any adverse effect even if the resilient contacting point is shifted slightly, since the flexible contact blade 36A is in resilient contact with the center contact portion 39A, i.e. a common contact. A magnitude of the rotational motion at a given point of the rotatable body 33 increases with a distance of that point from a center line drawn in phantom across the two projections 33A and 33B, i.e. the rotational axis of the rotatable body 33. Hence, the magnitude becomes smaller as the distance to the rotational axis becomes shorter. The flexible contact blade 36B shifts very slightly with a motion of the rotatable body 33, because it is closest to the rotational axis of the rotatable body 33. Moreover, since the flexible contact blade 36B stays on the insulated area without resiliently contacting any of the radial contact portions 39B, as described above, there is not the slightest chance for the rotary encoder unit 37 to generate an erroneous signal.

Figure 7:
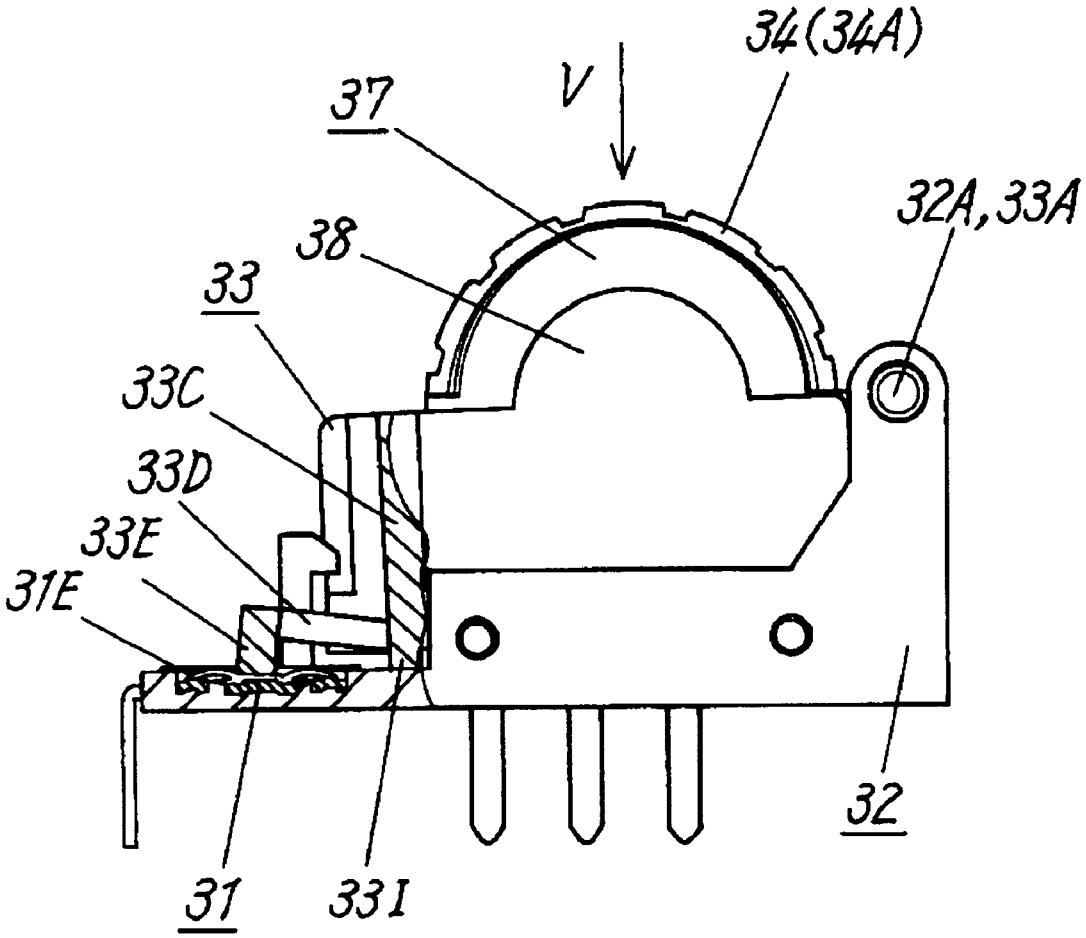
FIG. 7 is another partially sectioned side view of the same rotary encoder equipped with a push switch depicting first means for buffering a large depressing force applied to a cylindrical operating knob.

If an excessively large depressing force is applied vertically downward to the cylindrical operating knob 34, the flexible arm 33D of the rotatable body 33 elastically deforms by a predetermined dimension, as shown in FIG. 7, after the push switch unit 31 closes the circuit by elastic deformation of the resilient movable contact 31E. It is so constructed that a projection 33I provided on an underside surface of the longitudinal side frame 33C connecting the flexible arm 33D consequently strikes on the upper surface of the substrate body 32 in order to stop the depressing force. Therefore, the push switch unit 31 does not receive a depressing force greater than a force required for the elastic deformation of the flexible arm 33D. The projection 33E on the underside surface of the flexible arm 33D may be maintained to be in contact resiliently with the top end of the push switch unit 31 with the flexible arm 33D kept deformed slightly under the normal condition, so as to prevent the rotatable body 33 from making an abnormal sound due to an angular play in the rotational direction.

As described above, the push and rotary operating type electronic device of the present exemplary embodiment is provided with a large cylindrical manipulating surface, yet it can reduce a height dimension of an enclosure of the equipment in which this push and rotary operating type electronic device is housed. In addition, the push-to-operate type component can be manipulated smoothly, since the rotatable body can move around the supporting part at one side of it, during depressing manipulation the cylindrical operating knob. Furthermore, this electronic device has an advantage of providing high contact reliability with low cost, since it contains a small number of resilient contacts and contacting points.

Second Exemplary Embodiment

With reference to the accompanying figure, a rotary encoder equipped with a push switch will be described hereinafter as a representative of a push and rotary operating type electronic device of a second exemplary embodiment of the present invention.

Figure 8:
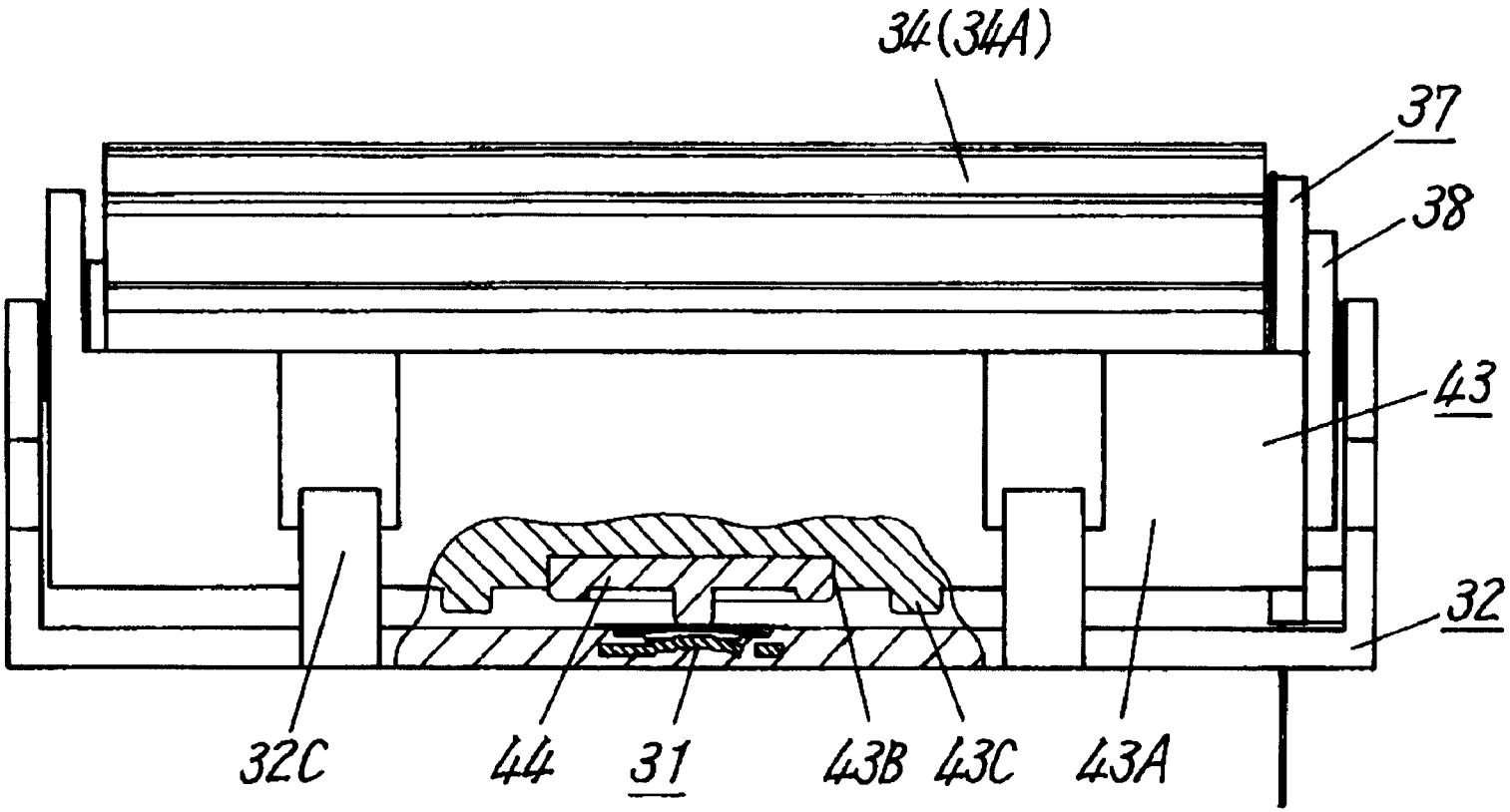
FIG. 8 is a partially sectioned front view of a rotary encoder equipped with a push switch depicting second means for buffering a large depressing force applied to the cylindrical operating knob in a second exemplary embodiment of the present invention.

FIG. 8 is a partially sectioned front view of the rotary encoder depicting a second means for preventing a large depressing force from being applied to the push switch unit 31 when the cylindrical operating knob 34 is being depressed downward. The rotary encoder of this exemplary embodiment is provided with an elastic actuator 44 instead of the flexible arm 33D and the projection 33E on its underside surface in the foregoing structure of the first exemplary embodiment. The elastic actuator 44 made of rubber or the like material has predetermined dimensions and a predetermined elasticity, and it is press-fitted in a cavity 43B provided in the center of a underside surface of a longitudinal side frame 43A located at an opposite side of a rotational axis of a rotatable body 43. A tip end of the elastic actuator 44 is placed to be in contact elastically with the top end of the push switch unit 31. A projection 43C is provided on each side of the elastic actuator 44 at a lower surface of the rotatable body 43.

According to the above configuration, when an excessively large depressing force is applied to the cylindrical operating knob 34, the elastic actuator 44 is compressed by a predetermined magnitude after the push switch unit 31 closes the circuit (in the case of a push-on type switch), and a projection 43C provided on each side of the elastic actuator 44 strikes on the upper surface of the substrate body 32 to stop the depressing force.

This push and rotary operating type electronic device of the present exemplary embodiment can provide a similar effectiveness while achieving a further reduction in size of the device than the structure of the first exemplary embodiment.

Third Exemplary Embodiment

Referring now to the accompanying figures, a rotary encoder equipped with a push switch will be described hereinafter as a representative of a push and rotary operating type electronic device of a third exemplary embodiment of the present invention.

Figure 9:
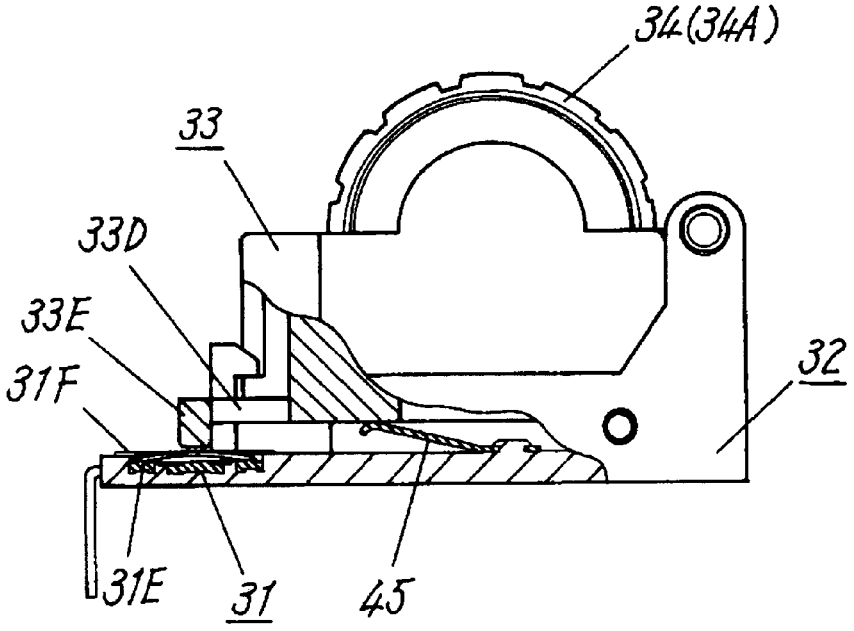
FIG. 9 is a partially sectioned side view of a rotary encoder equipped with a push switch depicting third means for buffering a large depressing force applied to the cylindrical operating knob in a third exemplary embodiment of the present invention.
Figure 10:
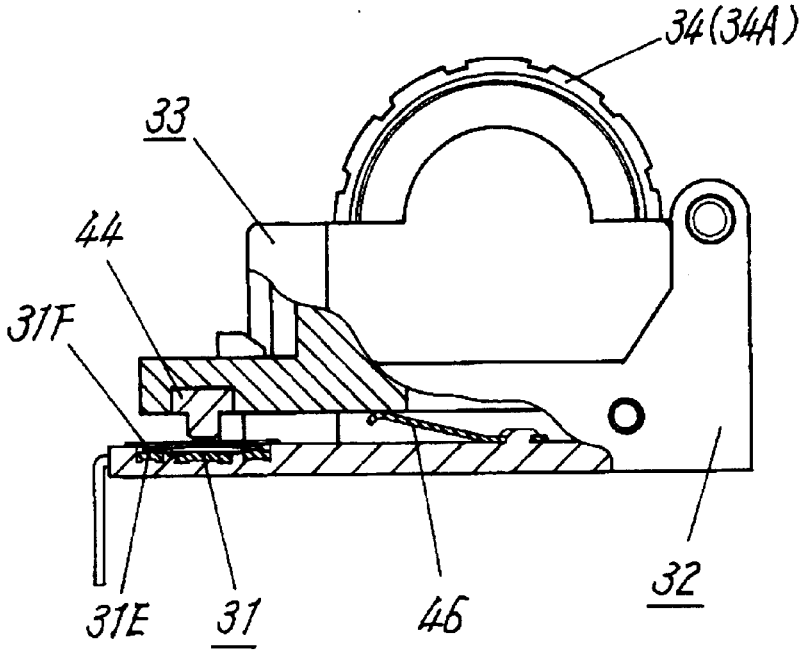
FIG. 10 is a partially sectioned side view of a rotary encoder equipped with a push switch depicting fourth means for buffering a large depressing force applied to the cylindrical operating knob in a third exemplary embodiment of the present invention.

FIG. 9 and FIG. 10 are partially sectioned side views depicting respectively third and fourth means of buffering a large depressing force applied to the cylindrical operating knob. These rotary encoders equipped with push switch are additionally provided with springs 45 and 46 respectively between their respective substrate bodies 32 and the rotatable bodies 33 for providing biasing forces in a direction to separate them with respect to each other. Further, a gap is provided between the tip end of the projection 33E on the underside surface of the flexible arm 33D and the flexible film 31F which is the top end of the push switch unit 31, or between the tip end of the elastic actuator 44 and the flexible film 31F, with the rotatable bodies 33 in an upper bound position within its movable range.

The depressing force required to manipulate the cylindrical operating knob 34 of the rotary encoders equipped with push switch can be greater than the force required for the resilient movable contact 31E of the push switch unit 31 to make a resilient deformation, with the spring 45 or 46. Moreover, the gap can provide an inactive stroke of the cylindrical operating knob 34, prior to a start of depressing the resilient movable contact 31E of the push switch unit 31 in the course of a depressing manipulation. The inactive stroke can reduce the likelihood of actuating the push switch unit 31 in error when, for example, turning the cylindrical operating knob 34, and prevent an abnormal sound due to the angular play in the rotatable body 33.

Fourth Exemplary Embodiment

Figure 11:
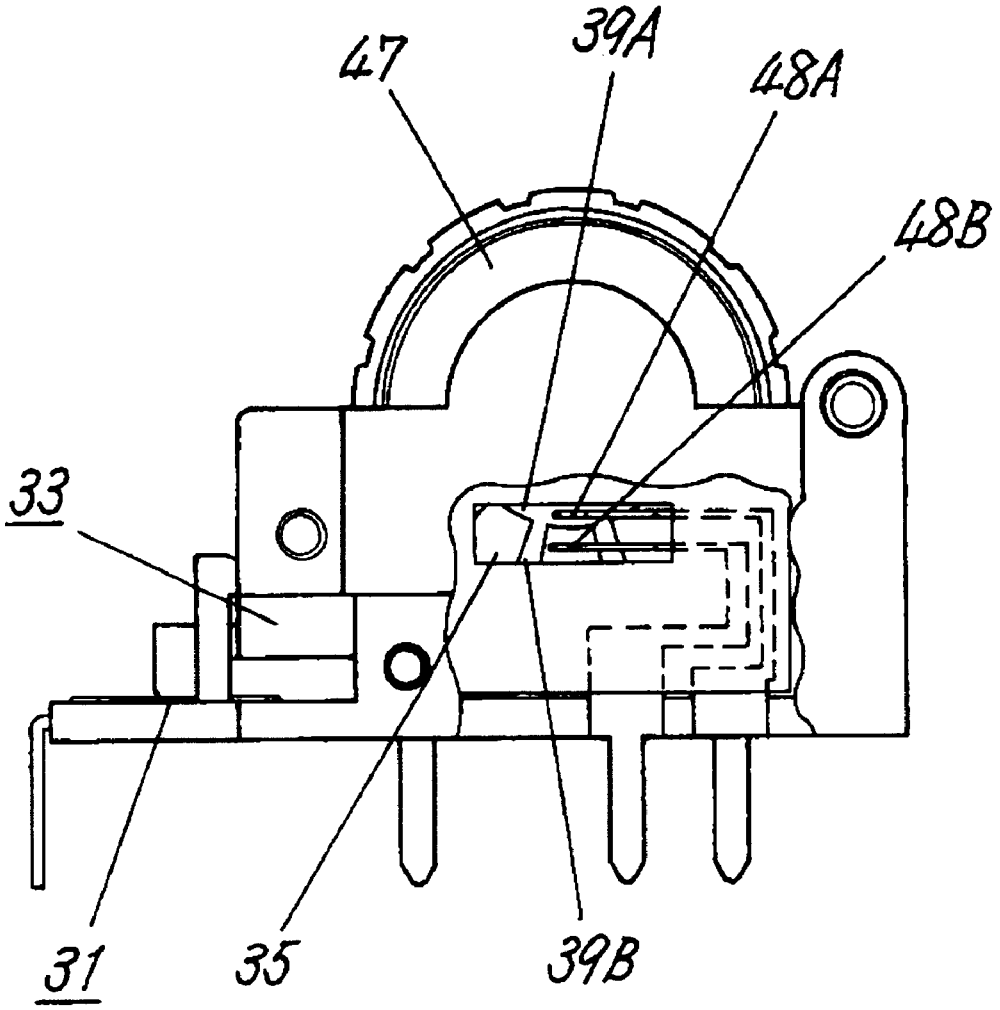
FIG. 11 is a partially sectioned side view depicting a rotary encoder equipped with a push switch, representing a push and rotary operating type electronic device of a fourth exemplary embodiment of the present invention.
Figure 12:
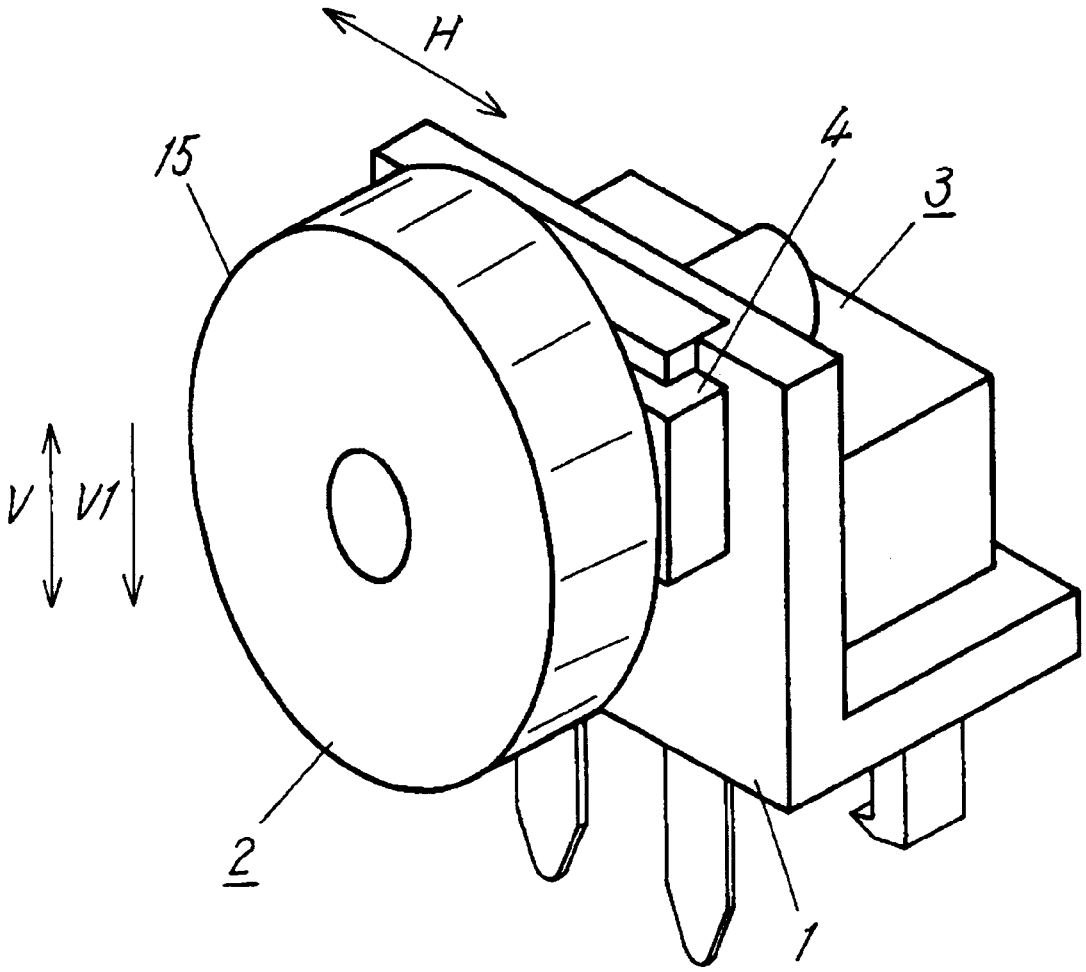
FIG. 12 PRIOR ART
FIG. 12 is a general perspective view depicting a rotary encoder equipped with a push switch, representing a push and rotary operating type electronic device of the prior art.
Figure 13:
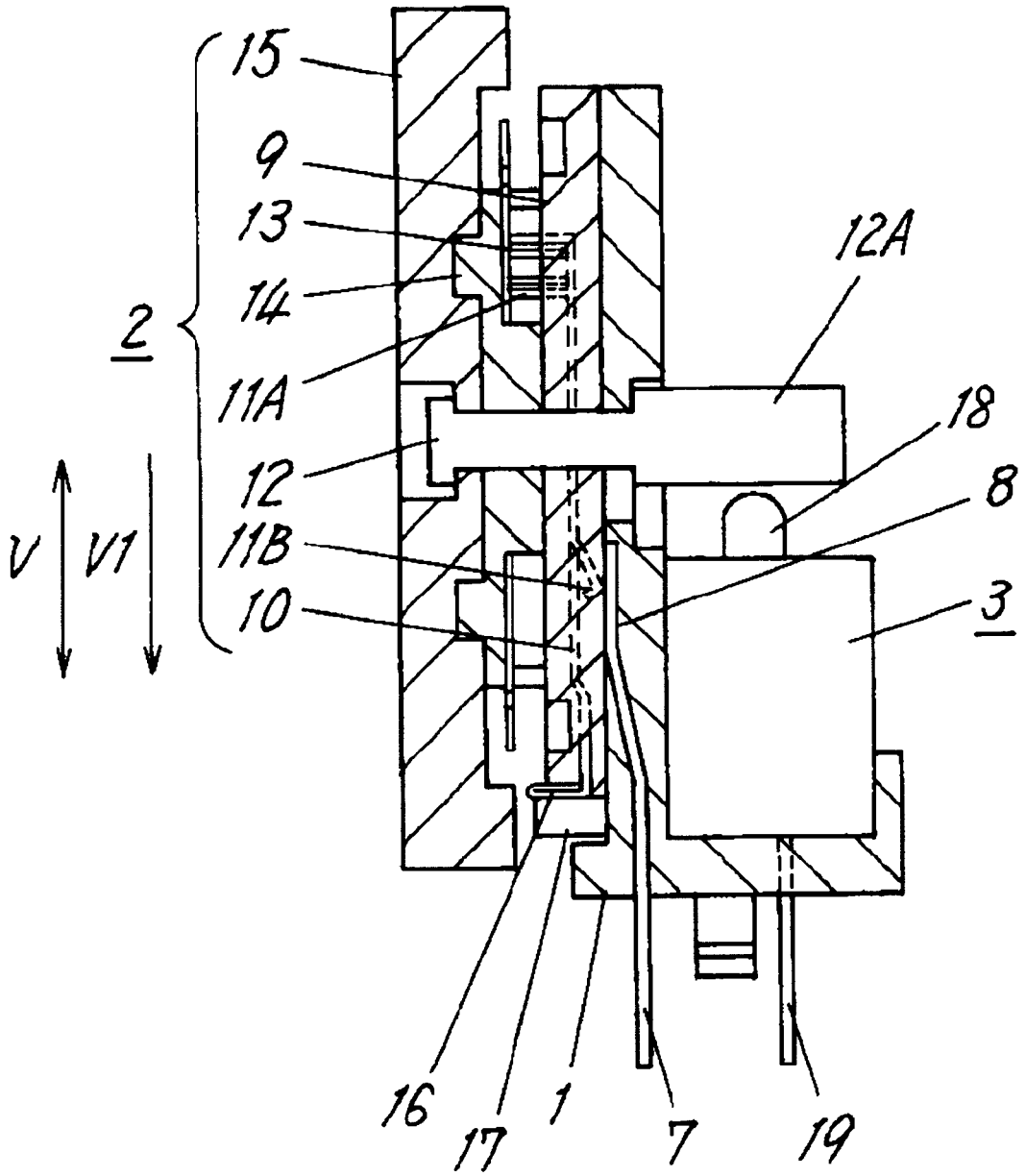
FIG. 13 PRIOR ART
FIG. 13 is a sectioned side view depicting the same rotary encoder equipped with a push switch.
Figure 14:
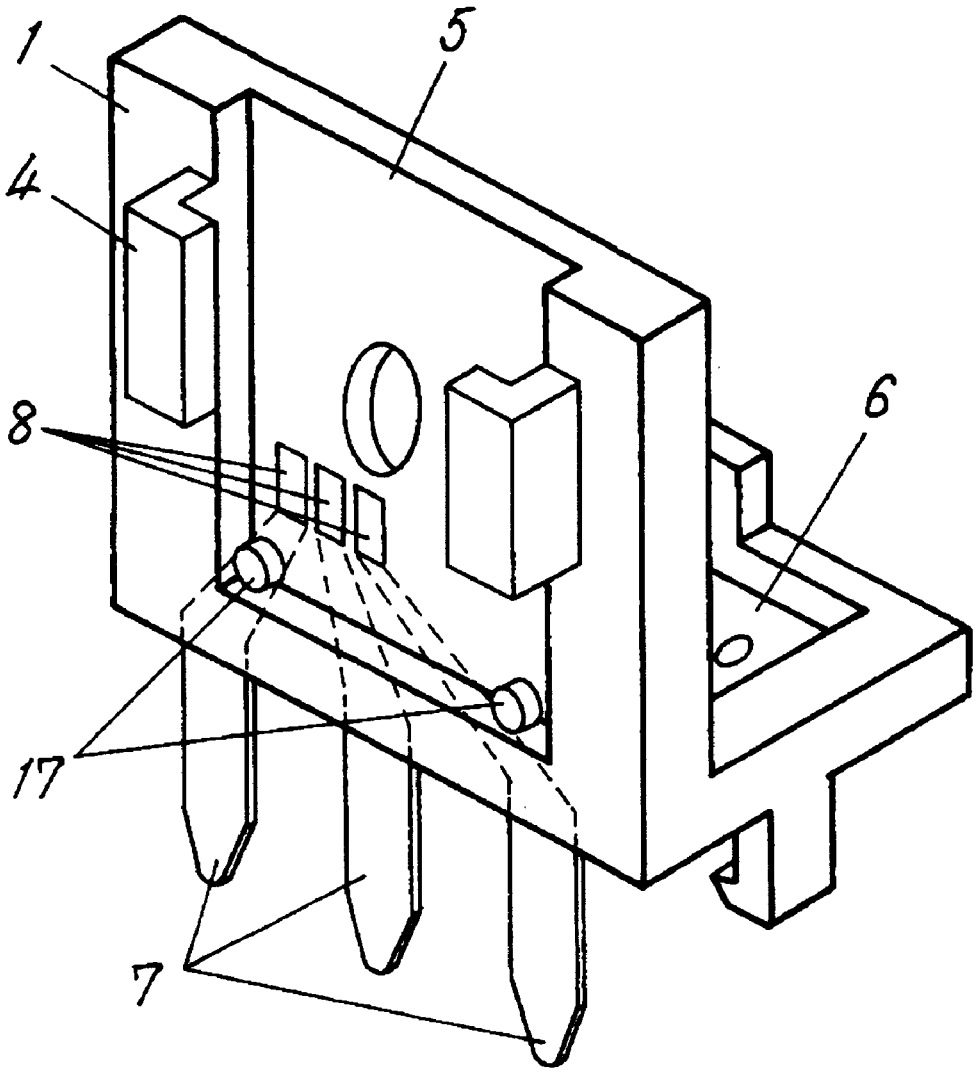
FIG. 14 PRIOR ART
FIG. 14 is a general perspective view depicting a mount board having contact points, representing an essential portion of the same rotary encoder equipped with a push switch.
Figure 15:
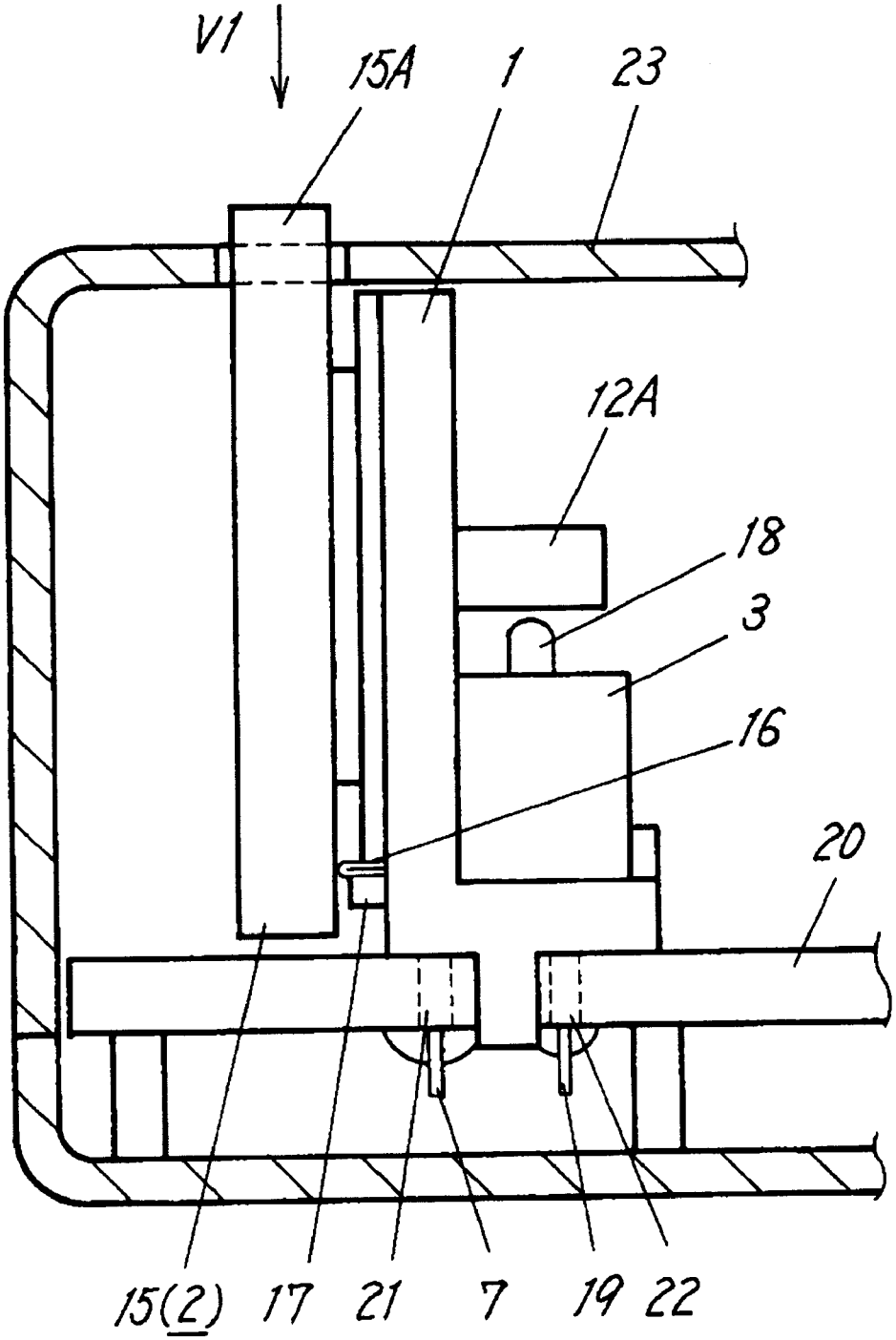
FIG. 15 PRIOR ART
FIG. 15 is a cross-sectioned partial view depicting a device wherein the same rotary encoder equipped with a push switch is installed.

FIG. 11 is a partially sectioned side view depicting a rotary encoder equipped with a push switch, representing a push and rotary operating type electronic device of a fourth exemplary embodiment of the present invention. A structure of this rotary encoder equipped with a push switch differs from that of the first exemplary embodiment, in which the positions where flexible contact blades 48A and 48B make resilient contact with a rotary contact plate 35 of a rotary encoder unit 47 are altered. The structure other than the above aspect is identical to the rotary encoder equipped with a push switch of the first exemplary embodiment. All elements having identical structure as those of the first exemplary embodiment are assigned the same reference numerals, and their description will be omitted.

In FIG. 11, the flexible contact blades 48A and 48B are so positioned that the positions where they make resilient contact with the rotary contact plate 35 of the rotary encoder unit 47 are on or very close to a line which passes through a center of the rotary contact plate 35 in a direction perpendicular to another line drawn between the center of the rotary contact plate 35 and a rotational axis, i.e. a center of the rotational motion of the rotatable body 33. The flexible contact blade 48B is so placed that it does not contact with any of the radial contact portions 39B, but remains in position on an insulated surface area, when the rotary contact plate 35 stays in any rotated position in which the resilient bulge 41A of the leaf spring 41 in contact resiliently with the interior side surface is caught in one of the ditches 40A among the radially-oriented ridges and ditches 40 (not shown in FIG. 11), in the same way as in the case of the first exemplary embodiment.

In the rotary encoder equipped with a push switch having the foregoing structure, the positions where the flexible contact blades 48A and 48B make resilient contact with the center contact portion 39A and the radial contact portions 39B on the rotary contact plate 35 shift slightly as the rotatable body 33 makes a rotational movement in the course of a depressing manipulation of the cylindrical operating knob 34 when actuating the push switch unit 31. However, an adverse effect of this shift can be avoided by allowing a fair margin in a dimension of a radial direction of the individual contacts on the rotary contact plate 35, i.e. an increase of a radius of the rotary contact plate 35 to a greater dimension than a predetermined value, since the flexible contact blades 48A and 48B shift their respective points of resilient contact in a direction of the radius, which is perpendicular to the line drawn in phantom between the center of the rotary contact plate 35 and the rotational axis, or the center of the rotational motion, of the rotatable body 33.

In the first through fourth exemplary embodiments, although what has been described in detail is examples of the rotary encoder in which a push-on type switch is equipped, a push-off type switch may also be used as the push switch unit.

Furthermore, although what has been described in detail in the foregoing exemplary embodiments is an example in that the rotary contact plate is mounted on one of the end surfaces of the cylindrical operating knob, one each of the rotary contact plates can be mounted on both of the end surfaces of the cylindrical operating knob.

As has been described, the present invention provides an advantageous effect of realizing the push and rotary operating type electronic device that has features including: (a) it has a large cylindrical manipulating surface, yet it can reduce a height dimension of an enclosure of the equipment in which this push and rotary operating type electronic device is housed; (b) the push-to-operate type component can be manipulated smoothly, since the rotatable body can move around the supporting part at one side of it, during depressing manipulation of the cylindrical operating knob; and (c) it provides a push and rotary operating type electronic device with high contact reliability at a low cost, since it contains a small number of resilient contacts and contacting points.

What is claimed is:

1. A push and rotary operating type electronic device comprising:

a cylindrical operating knob rotatably supported at both ends thereof;

a rotatable body for rotatably supporting said cylindrical operating knob;

a substrate body for supporting said rotatable body;

a pushable component disposed on said substrate body, said pushable component depressed responsive to movement of said rotatable body toward said pushable component;

a rotary contact plate including an electric contact surface disposed on at least one end surface of said cylindrical operating knob; and a contact bar including a flexible contact blade in contact resiliently with said electric contact surface on said rotary contact plate, disposed on said substrate body.

2. The push and rotary operating type electronic device according to claim 1, wherein said rotatable body comprises an actuating part having resiliency for depressing said pushable component with a rotational movement thereof.

3. The push and rotary operating type electronic device according to claim 1, wherein said rotary operating type component is a rotary encoder and said pushable component is a push switch.

4. The push and rotary operating type electronic device according to claim 1, wherein:

a plurality of radially-oriented ditches and ridges are provided on one of an end surface of said cylindrical operating knob and said rotary contact plate;

a resilient body having a bulge is provided on said rotatable body in a manner to keep resilient contact with said plurality of radially-oriented ditches and ridges; and said rotary contact plate stays in a position where said flexible contact blade remains in contact with a surface other than said electric contact surface, when said bulge slips into one of ditches amongst said plurality of radially-oriented ditches and ridges.

5. The push and rotary operating type electronic device according to claim 4, wherein said contact bar is fixed to said substrate body in a manner that said flexible contact blade makes resilient contact with said rotary contact plate on or close to a line drawn between a center of said rotary contact plate and a rotational axis, said rotational axis being a center of a rotating motion of said rotatable body.

6. The push and rotary operating type electronic device according to claim 4, wherein said contact bar is fixed to said substrate body in a manner that said flexible contact blade makes resilient contact with said rotary contact plate on or close to a line, which passes through a center of said rotary contact plate in a direction perpendicular to another line drawn between a center of said rotary contact plate and a rotational axis, said rotational axis being a center of a rotating motion of said rotatable body.

7. A push and rotary operating type electronic device comprising:

a cylindrical operating knob;

a rotatable body for rotatably supporting said cylindrical operating knob;

a substrate body for supporting said rotatable body;

a pushable component disposed on said substrate body, said pushable component depressed responsive to movement of said rotatable body toward said pushable component;

a rotary contact plate including an electric contact surface disposed on at least one end surface of said cylindrical operating knob;

a contact bar including a flexible contact blade in contact resiliently with said electric contact surface on said rotary contact plate, disposed on said substrate body; and a spring disposed between said rotatable body and said substrate body for providing a biasing force in a direction of separating said rotatable body and said substrate body with respect to each other.

8. A push and rotary operating type electronic device comprising:

a cylindrical operating knob;

a rotatable body for rotatably supporting said cylindrical operating knob;

a substrate body for supporting said rotatable body;

a pushable component disposed on said substrate body, said pushable component depressed responsive to movement of said rotatable body toward said pushable component;

a rotary contact plate including an electric contact surface disposed on at least one end surface of said cylindrical operating knob; and a contact bar including a flexible contact blade in contact resiliently with said electric contact surface on said rotary contact plate, disposed on said substrate body;

wherein said rotatable body is supported rotatably from two ends at one side thereof in a direction parallel to a rotary axis of said cylindrical operating knob, in a supporting span wider than a longitudinal dimension of said cylindrical operating knob; and said pushable component is disposed at a side opposite to said one side in substantially mid point between two portions supporting said two ends of said rotatable body.

9. A push and rotary operating type electronic device comprising:

a cylindrical operating knob;

a rotatable body for rotatably supporting said cylindrical operating knob;

a substrate body for supporting said rotatable body;

a pushable component disposed on said substrate body, said pushable component depressed responsive to movement of said rotatable body toward said pushable component;

a rotary contact plate including an electric contact surface disposed on at least one end surface of said cylindrical operating knob;

a contact bar including a flexible contact blade in contact resiliently with said electric contact surface on said rotary contact plate, disposed on said substrate body;

a plurality of radially-oriented ditches and ridges provided on one of an end surface of said cylindrical operating knob and said rotary contact plate; and a resilient body having a bulge provided on said rotatable body in a manner to keep resilient contact with said plurality of radially-oriented ditches and ridges;

wherein said rotary contact plate stays in a position where said flexible contact blade remains in contact with a surface other than said electric contact surface, when said bulge slips into one of ditches amongst said plurality of radially-oriented ditches and ridges;

said cylindrical operating knob is provided with a recess at one of the end surfaces and a circular hole in a center of the other one of the end surfaces;

said rotary contact plate is fixed in an inner periphery of said recess;

said cylindrical operating knob is rotatably supported by inserting from an exterior side a supporting axle of thin diameter fixed to said rotatable body through a small circular hole in a center of said rotary contact plate, and inserting another supporting axle projecting from said rotatable body into a circular hole in the other end surface;

said contact bar is fixed to said substrate body in a manner that said flexible contact blade makes resilient contact with said electric contact surface on an exterior side surface of said rotary contact plate; and said bulge on said resilient body fixed to said supporting axle of thin diameter is maintained to be in contact resiliently with said plurality of radially-oriented ditches and ridges on an interior side surface of said rotary contact plate with a space of said recess.

10. The push and rotary operating type electronic device according to claim 9 further comprising a flexible contact having an electrical continuity to a grounding terminal and fixed to said substrate body, wherein:

said rotatable body, said supporting axle of thin diameter and said resilient body are made of metallic material; and said flexible contact is maintained to be in contact resiliently with said rotatable body.

* * * * *